US010702027B2

(12) United States Patent
Lee

(10) Patent No.: US 10,702,027 B2
(45) Date of Patent: Jul. 7, 2020

(54) FASTENER FOR ZIPPER

(71) Applicant: Ji Hye Lee, Gyeongsangnam-do (KR)

(72) Inventor: Ji Hye Lee, Gyeongsangnam-do (KR)

( * ) Notice: Subject to any disclaimer, the term of this patent is extended or adjusted under 35 U.S.C. 154(b) by 0 days.

(21) Appl. No.: 16/239,285

(22) PCT Filed: Dec. 27, 2016

(86) PCT No.: PCT/KR2016/015306
§ 371 (c)(1),
(2) Date: Jan. 3, 2019

(87) PCT Pub. No.: WO2018/016698
PCT Pub. Date: Jan. 25, 2018

(65) Prior Publication Data

US 2019/0231035 A1 Aug. 1, 2019

(30) Foreign Application Priority Data

Jul. 19, 2016 (KR) ..... 10-2016-0091373
Dec. 22, 2016 (KR) ..... 10-2016-0176365

(51) Int. Cl.
*A44B 19/28* (2006.01)
*A44B 19/26* (2006.01)

(52) U.S. Cl.
CPC ..... *A44B 19/28* (2013.01); *A44B 19/26* (2013.01)

(58) Field of Classification Search
CPC ..... A44B 19/28; A44B 19/26; Y10T 24/2588; Y10T 24/2563
See application file for complete search history.

(56) References Cited

U.S. PATENT DOCUMENTS 2,079,722 A * 5/1937 Sundback ..... A44B 19/26 156/257
2,373,523 A * 4/1945 Winterhalter ..... A44B 19/30 24/421
2,764,794 A * 10/1956 Meech ..... A44B 19/28 24/416

(Continued)

FOREIGN PATENT DOCUMENTS

CN 108024601 A 5/2018
JP 50-018402 U 2/1975
JP 2004049504 A 2/2004
JP 2014523788 A 9/2014

(Continued)

OTHER PUBLICATIONS

World Intellectual Property Organization, International Search Report for International Application No. PCT/KR2016/015306, dated Mar. 22, 2017, 5 total pages with translation.

(Continued)

*Primary Examiner* — Robert Sandy
*Assistant Examiner* — Louis A Mercado
(74) *Attorney, Agent, or Firm* — Studebaker & Brackett PC

(57) ABSTRACT

The present disclosure relates to a fastener for a zipper which includes a top plate; a bottom plate located corresponding to the top plate; and a head which is located in a fixed region of a top surface of the top plate and is separable from the top plate. Since the head is separable from the top plate, the traction tab can be replaced, and thus, it is possible to apply various forms of traction tabs to fastener for zipper in accordance with user's feelings and user's needs.

12 Claims, 12 Drawing Sheets

(56) References Cited

U.S. PATENT DOCUMENTS

| | | | | |
|---|---|---|---|---|
| 3,239,905 | A * | 3/1966 | Weiner | A44B 19/306 24/421 |
| 5,195,221 | A * | 3/1993 | Kanamaru | A44B 19/26 24/419 |
| 5,621,954 | A * | 4/1997 | Mizuno | A44B 19/26 24/429 |
| 6,622,351 | B2 * | 9/2003 | Takasawa | A44B 19/26 24/389 |
| 7,089,632 | B2 * | 8/2006 | Keyaki | A44B 19/26 24/429 |
| 8,539,651 | B1 | 9/2013 | Williams | |
| 9,003,614 | B2 * | 4/2015 | Ozawa | A44B 19/26 24/429 |
| 9,173,457 | B2 * | 11/2015 | Lee | A44B 19/26 |
| 9,661,900 | B2 * | 5/2017 | Matsushima | A44B 19/26 |
| 10,085,525 | B2 * | 10/2018 | Yabuya | A44B 19/262 |
| 2003/0061691 | A1 | 4/2003 | Lee | |
| 2003/0154578 | A1 * | 8/2003 | Tenjin | A44B 19/26 24/430 |

FOREIGN PATENT DOCUMENTS

| | | | |
|---|---|---|---|
| JP | 07-100007 | | 4/2015 |
| KR | 20090012096 | U | 11/2009 |
| KR | 101196382 | B1 | 11/2012 |
| KR | 20120125099 | A | 11/2012 |
| KR | 20140004549 | U | 8/2014 |
| KR | 20150056281 | A | 5/2015 |
| KR | 101790446 | B1 | 10/2017 |
| KR | 101800138 | B1 | 11/2017 |
| WO | 2018016698 | A1 | 1/2018 |

OTHER PUBLICATIONS

Korean Intellectual Property Office, Notice of Allowance for Korean Application No. KR10-2016-0091373, dated Sep. 27, 2017, 1 page.
Korean Intellectual Property Office, Office Action for Korean Application No. KR10-2016-0091373, dated Jul. 7, 2017, 3 pages.
Japanese Intellectual Property Office, Rejection Notice Received for Application No. JP2017-537471, dated Dec. 11, 2018, 5 total pages.

* cited by examiner

【Fig. 1】
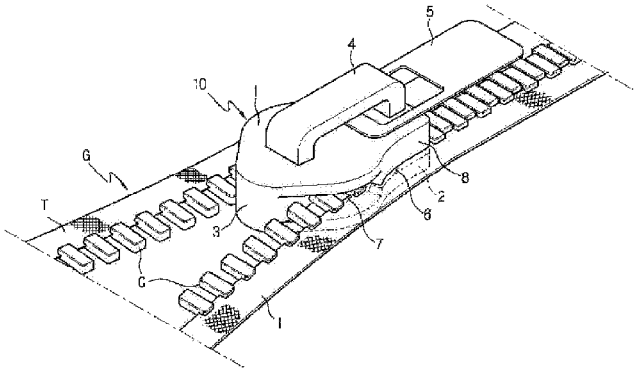
【Fig. 2】
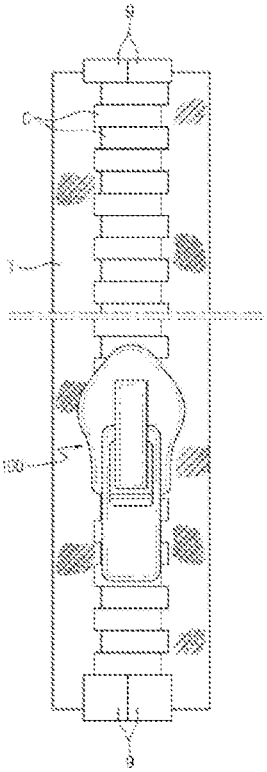

【Fig. 3】
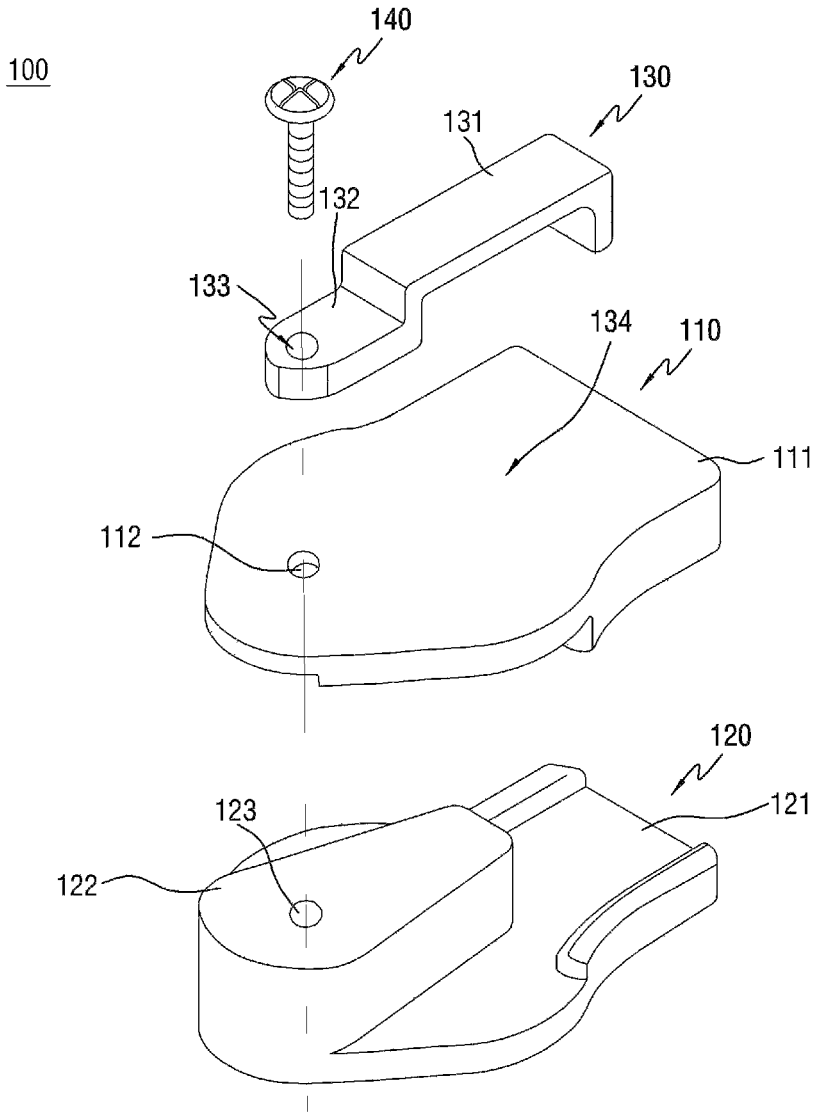

【Fig. 4】
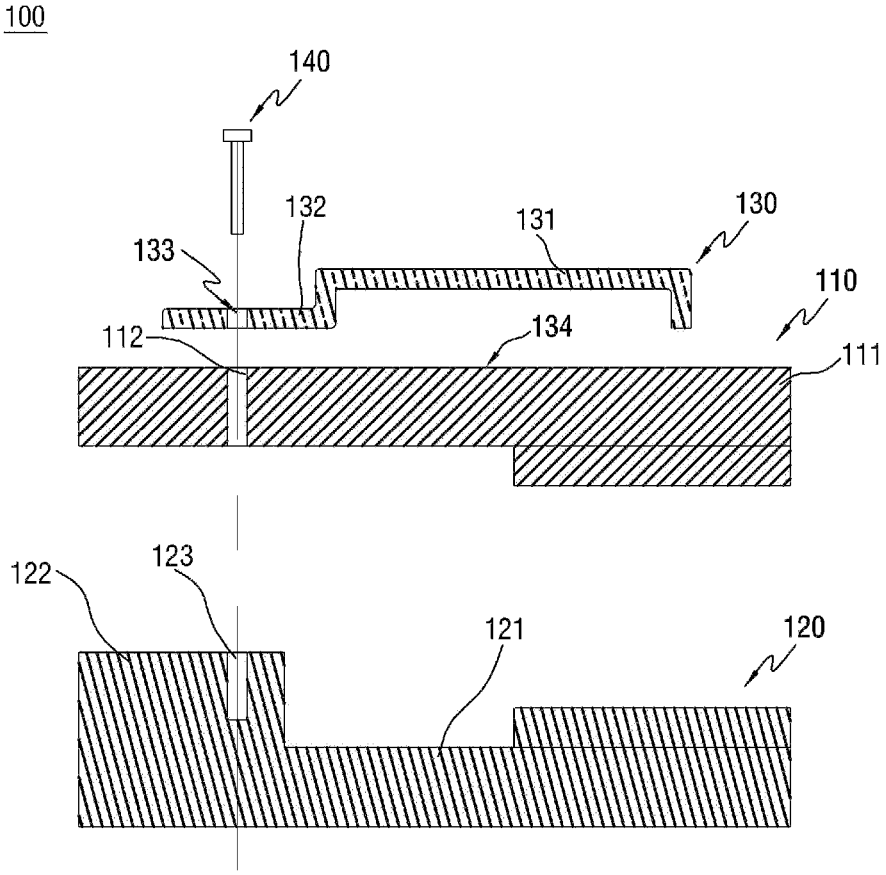

【Fig. 5】
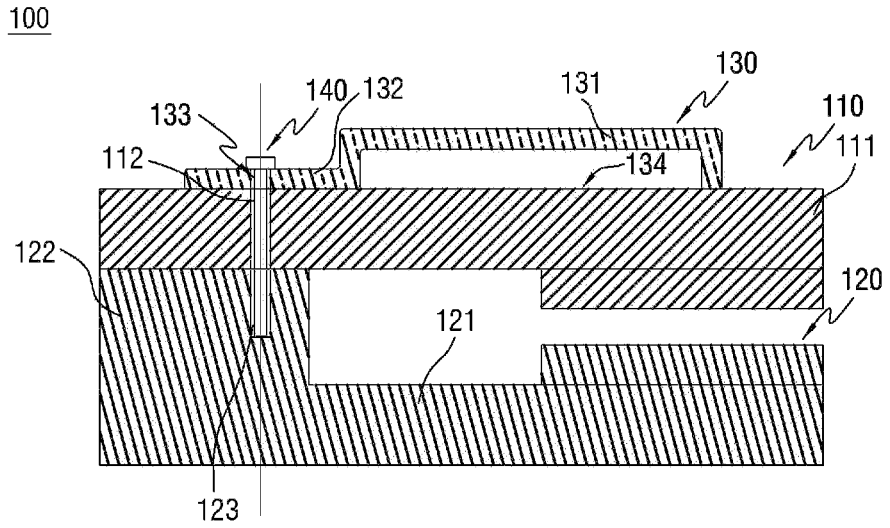
【Fig. 6】
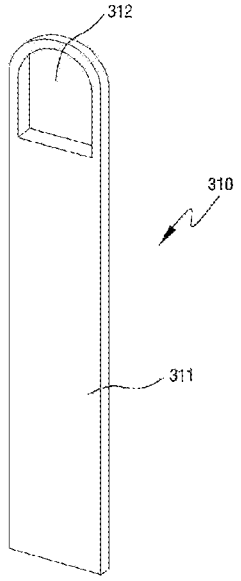

【Fig. 7】
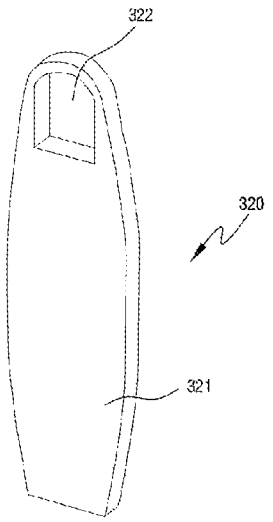
【Fig. 8】
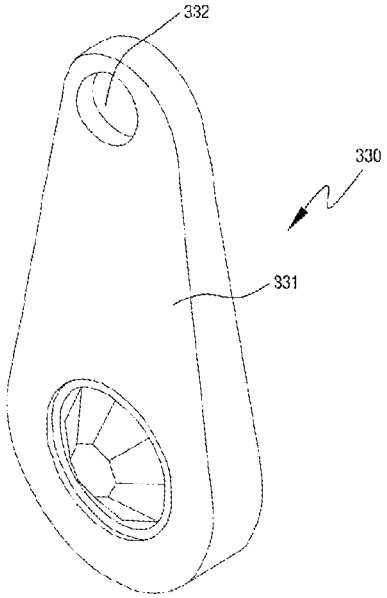

【Fig. 9】
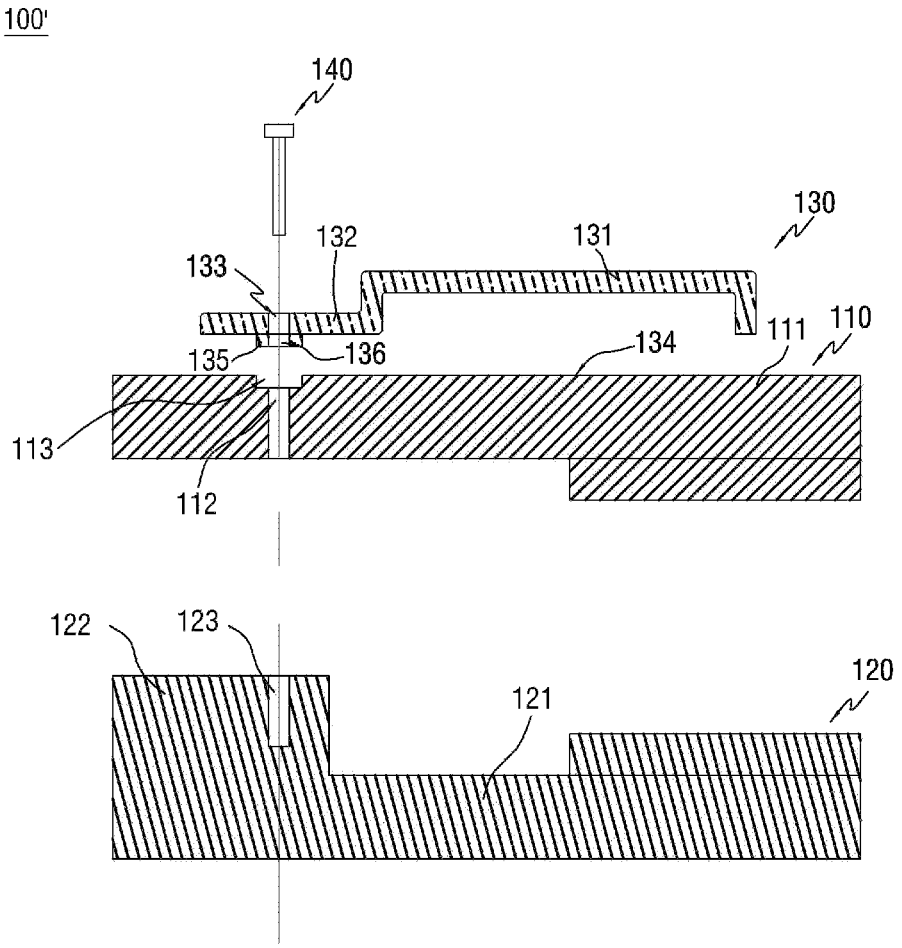

【Fig. 10】
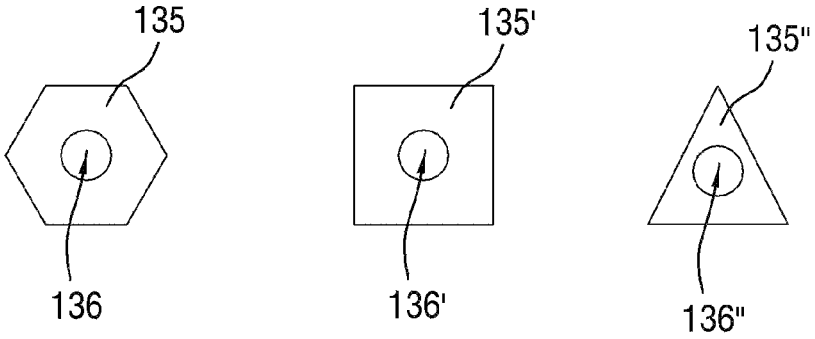
【Fig. 11】
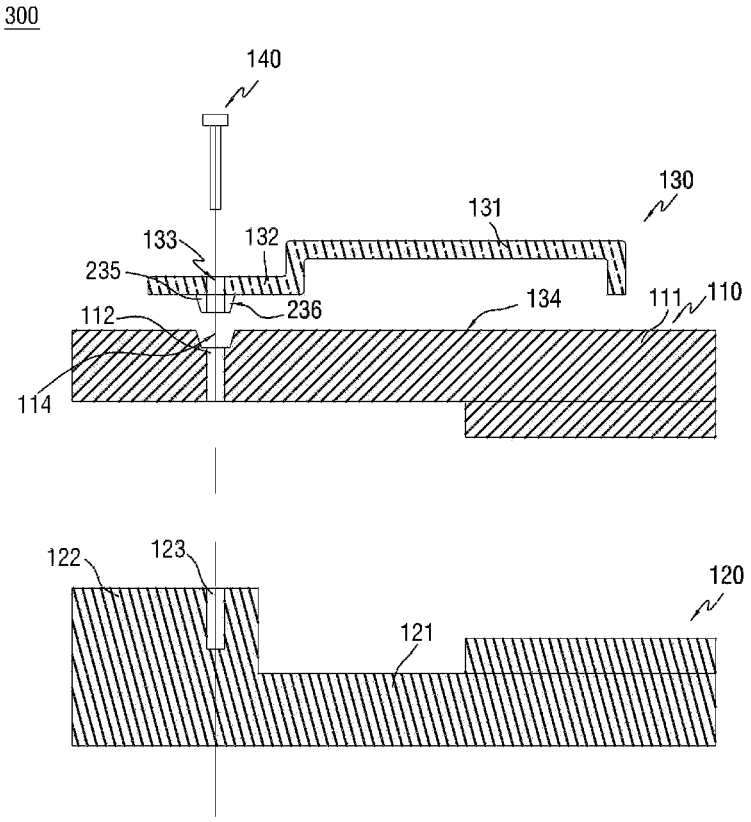

【Fig. 12】
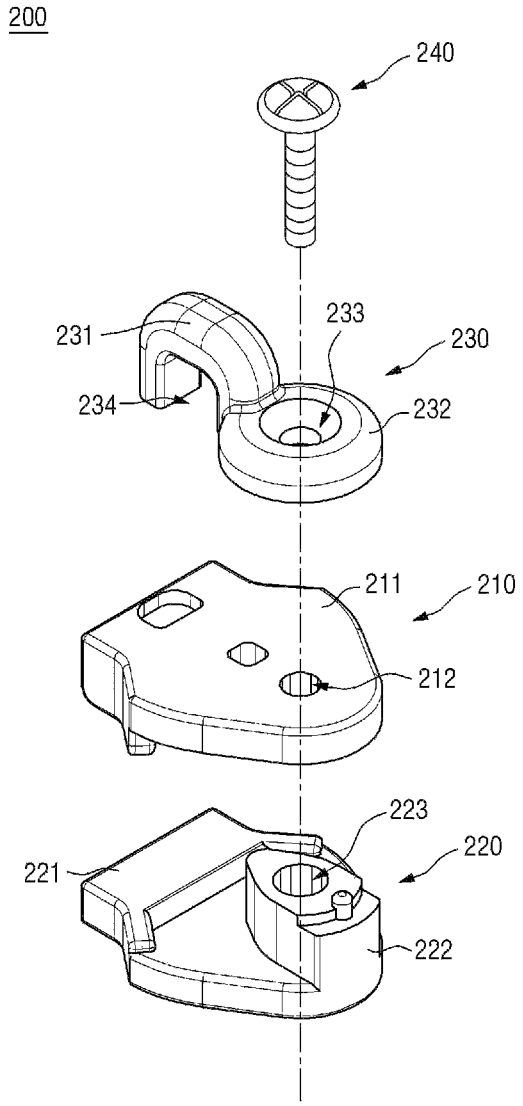

【Fig. 13】
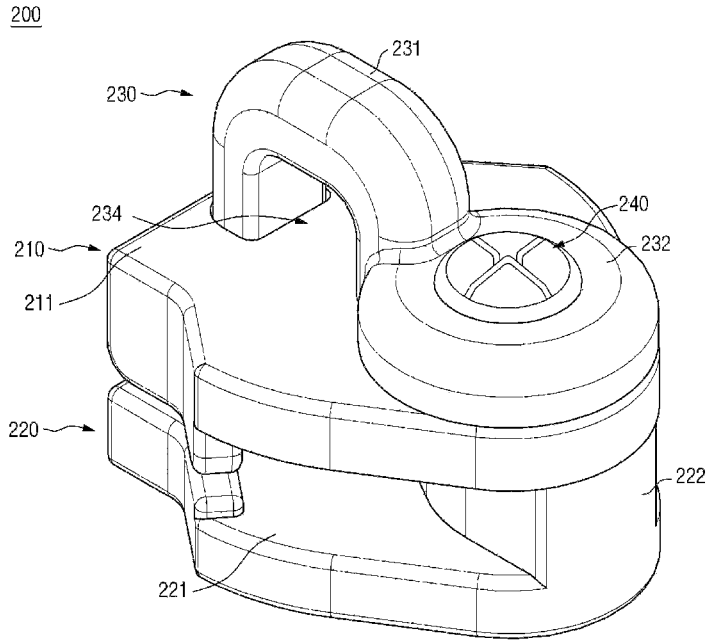
【Fig. 14】
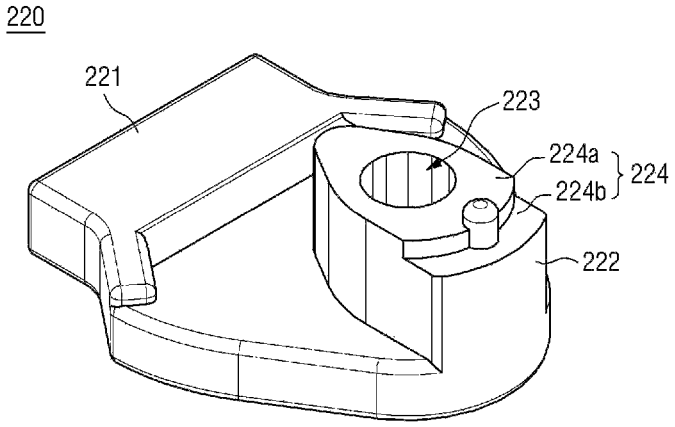

【Fig. 15】
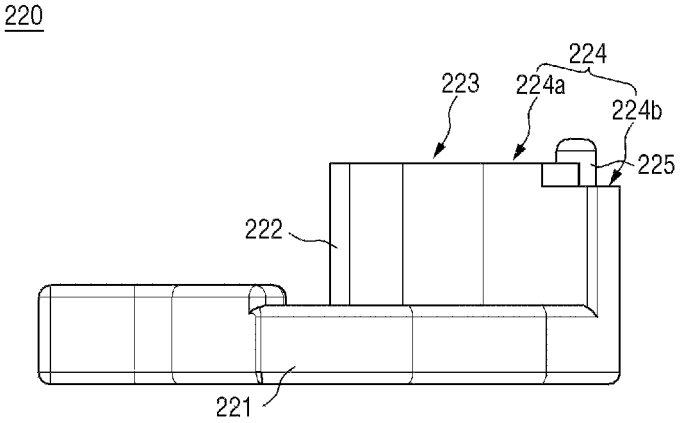
【Fig. 16】
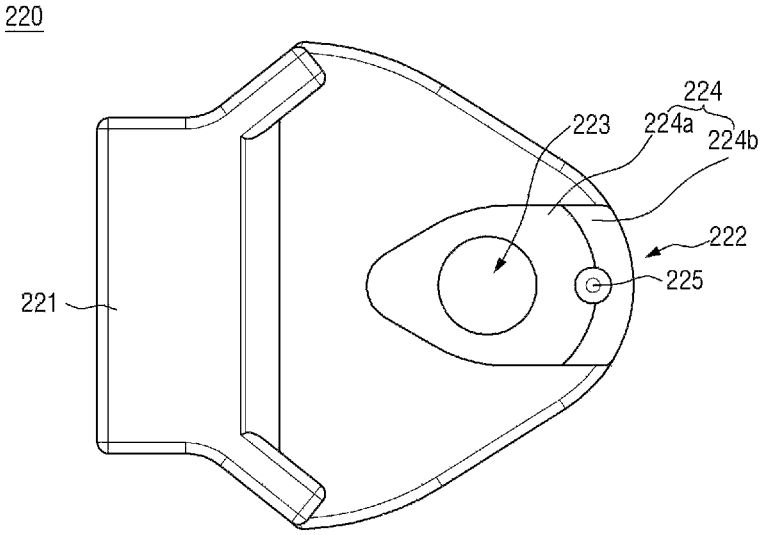

【Fig. 17】
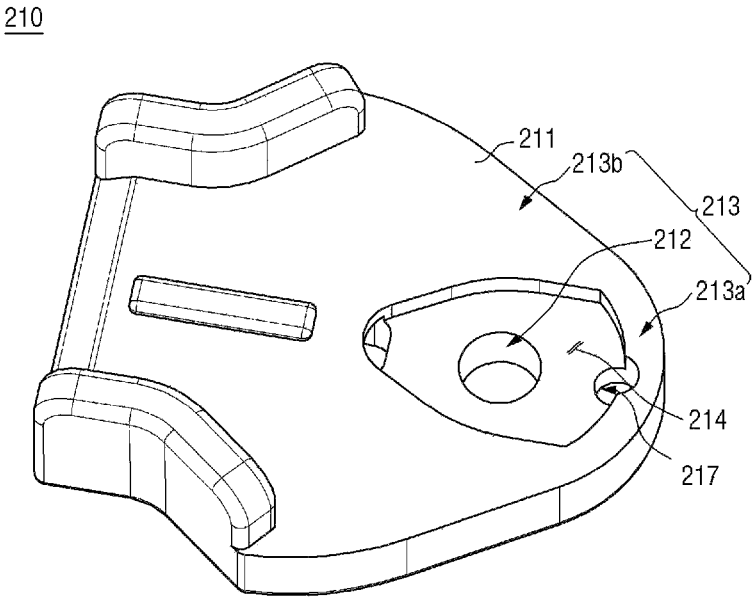
【Fig. 18】
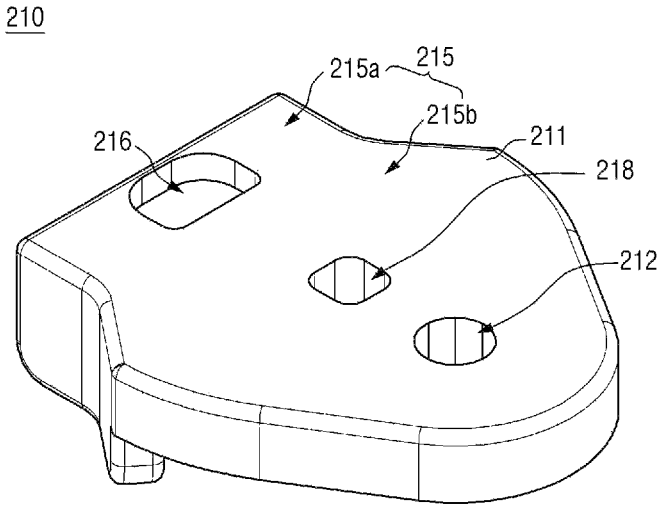

【Fig. 19】
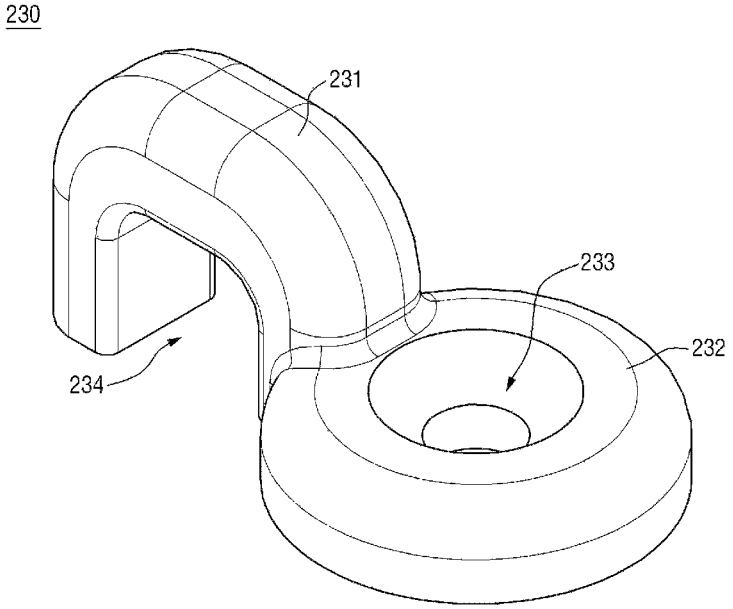
【Fig. 20】
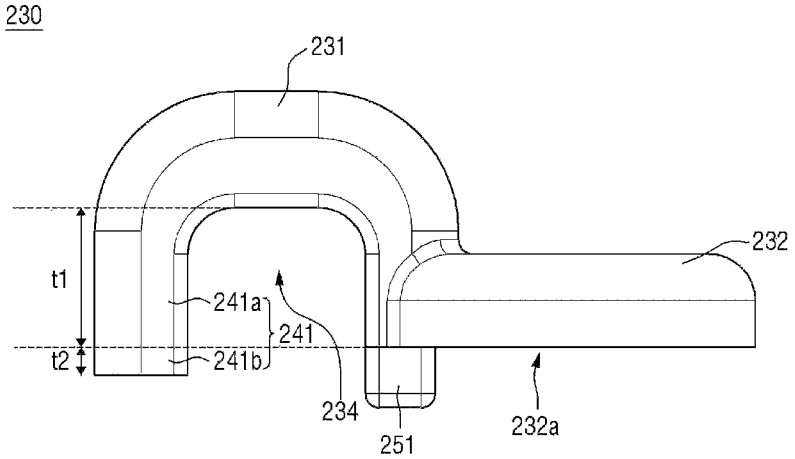

FASTENER FOR ZIPPER

CROSS-REFERENCE TO RELATED APPLICATIONS

The present application is a national phase of International PCT Patent Application No. PCT/KR2016/015306, filed Dec. 27, 2016, which claims priority to Korean Patent Application No. 10-2016-0091373, filed Jul. 19, 2016, now Patent No. KR101790446 (B1), granted Oct. 25, 2017, and also claims priority to Korean Patent Application No. 10-2016-0176365, filed Dec. 22, 2016, now Patent No. KR101800138 (B1), granted Nov. 21, 2017, all of which are incorporated herein by reference in their entirety.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

The present invention relates to a fastener for zipper, and more particularly, to a fastener for zipper capable of replacing a traction tab.

In general, zippers have been formed and used in open parts to easily put on and take off clothes such as one piece, jumpers, trousers and the like.

The zipper is configured to include a pair of support tapes formed on both sides of the open part.

A pair of chains spaced apart from each other at regular intervals in a longitudinal direction is formed on the support tape, respectively. A fastener for zipper is used to combine or separate each of the pair of chains formed on the support tape.

FIGS. 1 and 2 are diagrams for explaining a state of use of a conventional fastener for zipper.

Referring to FIGS. 1 and 2, a conventional fastener for zipper 10 is formed integrally with a top plate 1, a bottom plate 2 and a guide post 3.

A head 4 combined with the traction tab 5 is formed on the top plate 1. On both sides of the top plate 1, a separation prevention flange 8 is formed downward. Chain housing portions 7 are formed between the separation prevention flange 8 and the guide post 3, respectively.

The support tape housing portion 6 is formed between the separation prevention flange 8 and the bottom plate 2.

At this time, as illustrated in FIG. 1, when the fastener for zipper 10 houses the support tape T by the support tape housing portion 6, the chains C formed on the support tape T are inserted into the chain housing portions 7 formed in the fastener 10, respectively.

The chains C inserted into the chain housing portions 7 are prevented from being separated to both sides by the separation prevention flanges 8 formed on both sides of the top plate 1.

When the fastener for the zipper 10 which houses the support tape T advances in the fixed direction, the chain C is combined, and when the fastener for zipper 100 advances in the opposite direction, the chain C is separated, and the zipper G are opened and closed.

Further, as illustrated in FIG. 2, stop members 9 are formed in the upper and lower parts of the support tape T in order to prevent a situation in which the fastener for the zipper 10 which houses the support tape T formed on clothes (not illustrated) advances in the fixed direction or the opposite direction and the support tape T is separated from the support tape housing portion 6.

After the support tape T formed in the open part is housed in the fastener for the zipper 10 at the stage of fabricating the clothes in this way, the upper and lower parts of the support tape are finished with the stop members. The conventional fastener for zipper 10 in which the top plate A, the bottom plate 2 and the guide post 3 are formed integrally is used together with a zipper G in which the upper and lower parts of the support tape G are finished, as one piece.

Meanwhile, in the fastener for zipper used in the process of putting on and taking off the clothes, the fastener for zipper continuously advances through the traction tab 5 in the fixed direction or the opposite direction, while grasping the traction tab 5 with hands, thereby separating or combining the chain C.

At this time, in the conventional fastener for zipper, since the traction tab 5 is used in a state of being fastened to the head 4, the traction tab 5 has not a structure that can be separated from the head 4.

Therefore, the traction tab 5 is actually used only as a means for moving the fastener for zipper.

Meanwhile, the traction tab 5 may be configured in various forms, but if the traction tab 5 may be separated from the head 4, the replacement of the traction tab 5 is permitted. Therefore, various types of traction tabs may be applicable to the fastener for zippers in accordance with the feeling of the user. However, at the present time, a fastener for zipper that can replace the traction tab has not been developed at all.

SUMMARY

An object of the present invention is to provide a fastener for zipper in which the traction tab can be separated from the head and the traction tab can be replaced.

Another object of the present invention is to provide a fastener for zipper capable of applying various types of traction tabs in accordance with the feeling of the user.

The objects of the present invention are not limited to the above-mentioned objects and another object that has not been mentioned can be clearly understood by those skilled in the art from the description below.

In order to solve the aforementioned problems pointed out, the present invention provides a fastener for zipper which includes a top plate; a bottom plate located to correspond to the top plate; and a head which is located in a certain region of a top surface of the top plate and is separable from the top plate.

Further, the present invention provides a fastener for zipper in which the top plate includes a first base plate; and a first fastening hole located on the first base plate, the bottom plate includes a second base plate; a guide post located in front of the second base plate; and a second fastening hole located in the guide post and located in the region corresponding to the first fastening hole, and the head includes a body portion including a traction tab housing portion; a flange portion extending to one distal end of the body portion; and a third fastening hole located in a certain region of the flange portion and located in a region corresponding to the first fastening hole.

Further, the present invention provides a fastener for zipper further including fastening means inserted into and fastened to the third fastening hole third fastening hole, when the fastening means is combined to the first fastening hole and the third fastening hole, the top plate and the head are fastened to each other, and when the fastening means is separated from the first fastening hole and the third fastening hole, the top plate and the head are separated from each other.

Further, the present invention provides a fastener for zipper further including fastening means inserted into and fastened to the first fastening hole, the third fastening hole and the second fastening hole, when the fastening means is combined to the first fastening hole, the third fastening hole and the second fastening hole, the top plate and the head are fastened to each other, and the top plate and the bottom plate are fastened to each other, and when the fastening means are separated from the first fastening hole, the third fastening hole and the second fastening hole, the top plate and the head are separated from each other, and the top plate and the bottom plate are separated from each other.

Further, the present invention provides a fastener for zipper in which the head further includes a polygonal protruding part protruding from the bottom surface of the flange portion, the protruding part including a fourth fastening hole located in a region corresponding to the third fastening hole, and the top plate further includes a protruding part housing groove which is located on the top surface of the first base plate and located continuously with the first fastening hole.

Further, the present invention provides a fastener for zipper in which an area of the shape of the polygonal protruding part becomes narrower toward the lower part, and an area of the shape of the protruding part housing groove becomes narrower toward to the lower part.

Further, the present invention provides a fastener for zipper in which the top plate includes a first base plate; and a first fastening hole located on the first base plate, the bottom plate includes a second base plate; a guide post located in front of the second base plate; and a second fastening hole located in the guide post and located in a region corresponding to the first fastening hole, and the head includes a body portion including a traction tab housing portion; a flange portion extending to one distal end of the body portion; and a third fastening hole located in a certain region of the flange portion and located in a region corresponding to the first fastening hole, and the guide post includes a guide post top surface, and the guide post top surface includes a first top surface on which the second fastening hole is located, and a second top surface located at an outer distal end of the guide post and having a level difference lower than the first top surface.

Further, the present invention provides a fastener for zipper in which the top plate includes a bottom surface of the first base plate, the bottom surface of the first base plate includes a first bottom surface of the first base plate located at one distal end of the first base plate; a second bottom surface of the second base plate as a region other than the first bottom surface of the first base plate; and a housing groove located in a certain region of the bottom surface of the first base plate and having a level difference lower than the first bottom surface of the first base plate, the top plate and the bottom plate are fastened to each other in a state in which the first bottom surface of the first base plate is in contact with the second top surface of the guide post top surface, and the top plate and the bottom plate are fastened to each other in a state in which the first top surface of the guide post top surface of the bottom plate is housed in the housing groove.

Further, the present invention provides a fastener for zipper in which the guide post further includes a protruding part located in a certain region of the top surface of the guide post, the bottom surface of the first base plate further includes a first groove portion disposed over the first bottom surface of the first base plate and the housing groove and having a level difference lower than the housing groove, and the top plate and the bottom plate are fastened to each other in a state in which the protruding part is housed in the first groove portion.

Further, the present invention provides a fastener for zipper in which the top plate includes the top surface of the first base plate, the top surface of the first base plate includes a first top surface of the first base plate located at the other distal end of the first base plate; a second top surface of the first base plate which is a region other than the first top surface of the first base plate; a support groove located in a certain region of the first top surface of the first base plate; and a second groove portion located between the support groove and the first fastening hole, the flange portion of the head includes a flange portion bottom surface, and the top plate and the head are fastened to each other in a state in which the flange portion bottom surface comes into contact with the top surface of the first base plate.

Further, the present invention provides a fastener for zipper in which the body portion of the head has a semi-annular shape, the flange portion extending in a first direction from one region of the semi-annular shape, the other region of the semi-annular shape includes a linear support, the support including a first support having a first length t1, and a second support extending from the first support and having a second length, and the support protrudes from the bottom surface the flange portion by the second length t2 of the second support.

Further, the present invention provides a fastener for zipper in which the head further includes a protruding part extending in a second direction from the one region of the semi-annular shape of the body portion.

Further, the present invention provides a fastener for zipper in which the top plate and the head are fastened to each other in the state in which the flange portion bottom surface comes into contact with the top surface of the first base plate of the top plate, the head and the top plate are fastened to each other in the state in which the second support of the support is inserted into the support groove, and the top plate and the head are fastened to each other in the state in which the protruding part is inserted into the second groove portion.

According to the present invention as described above, since the head can be separated from the top plate, it is possible to replace the traction tab and therefore it is possible to apply various forms of the traction tabs to the fastener for zippers in accordance with the feeling of the user or the needs of the user.

Further, in the present invention, it is preferable that the shape of the cross section of the protruding part be made up of a polygon and the polygonal protruding part be seated on the protruding part housing groove, thereby making it possible to prevent the head from unintentionally rotating from the top plate.

Further, in the present invention, the shape of the polygonal protruding part is configured to have an area which becomes narrower toward the lower part, and the shape of the protruding part housing groove is also configured to have an area which becomes narrower toward the lower part to correspond to the shape of the polygonal protruding part. Thus, the polygonal protruding part can be easily inserted into the protruding part housing groove.

Further, in the present invention, in a state in which the first top surface of the top surface of the guide post of the bottom plate is housed in the housing groove, the top plate and the bottom plate are fastened to each other. Thus, combining between the top plate and the bottom plate can be made stronger.

Further, in the present invention, the head and the top plate are fastened to each other while the second support of the support is inserted in the support groove, which makes it possible to prevent the head from unintentionally rotating from the top plate.

DESCRIPTION OF THE DRAWINGS

FIGS. 1 and 2 are diagrams for explaining a state of use of a conventional fastener for zipper;

FIG. 3 is a separated perspective view illustrating a fastener for zipper according to a first embodiment of the present invention, FIG. 4 is a separated cross-sectional view illustrating the fastener for zipper according to the first embodiment of the present invention, and FIG. 5 is a combined cross-sectional view illustrating the fastener for zipper according to the first embodiment of the present invention;

FIGS. 6 to 8 are schematic views illustrating various forms of traction tabs;

FIG. 9 is a separated cross-sectional view illustrating a zipper according to a second embodiment of the present invention, and FIG. 10 is a schematic plan view illustrating an example of a polygonal protruding part of a fastener for zipper according to the second embodiment of the present invention;

FIG. 11 is a separated cross-sectional view illustrating a fastener for zipper according to a third embodiment of the present invention;

FIG. 12 is a separated perspective view illustrating a fastener for zipper according to a fourth embodiment of the present invention, and FIG. 13 is a combined perspective view illustrating the fastener for zipper according to the fourth embodiment of the present invention;

FIG. 14 is a perspective view illustrating a bottom plate of a fastener for zipper according to a fourth embodiment of the present invention, FIG. 15 is a side view illustrating a bottom plate of the fastener for zipper according to the fourth embodiment of the present invention, and FIG. 16 is a plan view illustrating a bottom plate of the fastener for zipper according to the fourth embodiment of the present invention;

FIG. 17 is a perspective view in a first direction illustrating a top plate of a fastener for zipper according to the fourth embodiment of the present invention, and FIG. 18 is a perspective view in a second direction illustrating the top plate of the fastener for zipper according to the fourth embodiment of the present invention; and FIG. 19 is a perspective view illustrating the head of the fastener for zipper according to the fourth embodiment of the present invention, and FIG. 20 is a side view illustrating the head of the fastener for zipper according to the fourth embodiment of the present invention.

DETAILED DESCRIPTION

Advantages and features of the present invention and methods of achieving the same will become apparent with reference to the embodiments described in detail below in conjunction with the accompanying drawings. However, the present invention is not limited to the embodiments disclosed below, but may be provided in various different forms. The present embodiments are merely provided to make the disclosure of the present invention complete and to fully inform the category of the invention to a person having ordinary knowledge in the technical field to which the present invention pertains, and the present invention is only defined by the scope of the claims.

Specific contents for carrying out the present invention will be described in detail with reference to the accompanying drawings. Regardless of the drawings, the same reference numerals refer to the same elements, and the term "and/or" includes each of the mentioned items and one or more combinations.

Although the terms "first, second, and the like" are used to describe various constituent elements, these constituent elements are, of course, not limited by these terms. These terms are merely used to distinguish one constituent element from other constituent elements. Therefore, it is a matter of course that the first constituent element described below may be a second constituent element within the technical idea of the present invention.

The terms used in the present specification are for the purpose of illustrating the examples and do not limit the present invention. As used herein, the singular form also includes the plural forms unless specifically stated in a phrase. The terms "comprises" and/or "comprising" used in the specification do not exclude the presence or addition of one or more other constituent elements in addition to the referenced constituent elements.

Preferred embodiments of the present invention will be described in detail below with reference to the accompanying drawings.

FIG. 3 is a separated perspective view illustrating a fastener for zipper according to a first embodiment of the present invention, FIG. 4 is a separated cross-sectional view illustrating the fastener for zipper according to the first embodiment of the present invention, and FIG. 5 is a combined cross-sectional view illustrating the fastener for zipper according to the first embodiment of the present invention.

Referring to FIGS. 3 to 5, a fastener for zipper 100 according to a first embodiment of the present invention includes a top plate 110, and a bottom plate 120 located corresponding to the top plate 110, and includes a head 130 which is located in a certain region of the top surface of the top plate 110 and is separable from the top plate.

At this time, the top plate 110 may include a first base plate 111, and the head 130 may be located in a certain region of the top surface of the first base plate 111.

Further, the first base plate 111 includes a first fastening hole 112.

Continuously, referring to FIGS. 3 to 5, the bottom plate 120 includes a second base plate 121, and a guide post 122 located in front of the second base plate 121, and the guide post 122 includes a second fastening hole 123 located in a region corresponding to the first fastening hole 112.

At this time, in the present invention, the top plate 110 and the bottom plate 120 can be separated from each other, and the top plate and the bottom plate are fastened via fastening means 140 to be described later, or when removing the fastening means 140, the top plate 110 and the bottom plate 120 can be separated from each other.

Continuously, referring to FIGS. 3 to 5, the fastener for zipper 100 according to the first embodiment of the present invention includes the head 130 which is located in a certain region of the top surface of the top plate 110 and can be separated from the top plate.

At this time, as described above, the head 130 can be located in a certain region of the top surface of the first base plate 111.

Meanwhile, according to the present invention, the head 130 can be separated from the top plate. More specifically, the head 130 includes a body portion 131 including the traction tab housing portion 134, and a flange portion 132 extending to one distal end of the body portion 131.

Further, the head 130 includes a third fastening hole 133 located in a certain region of the flange portion 132 and located in a region corresponding to the first fastening hole 112.

Further, the fastener for zipper 100 according to the first embodiment of the present invention includes the fastening means 140 inserted and fastened to the first fastening hole 112 and the third fastening hole 133. When the fastening means 140 is combined to the first fastening hole 112 and the third fastening hole 133, the top plate 110 and the head 130 are fastened, and when the fastening means 140 is separated from the first fastening hole 112 and the third fastening hole 133, the top plate 110 and the head 130 can be separated.

At this time, the fastening means 140 can use combining means such as a known screw or bolt, but in the present invention, the kind of the fastening means 140 is not limited.

Further, as illustrated in the drawing, the fastening means 140 can be inserted into the first fastening hole 112 and the third fastening hole 133, and can be inserted into the second fastening hole 123.

By combining the fastening means 140 to the first fastening hole 112, the third fastening hole 133 and the second fastening hole 123, the top plate 110 and the head 130 can be fastened, and the top plate 110 and the bottom plate 120 can be fastened.

Further, by separating the fastening means 140 from the first fastening hole 112, the third fastening hole 133 and the second fastening hole 123, the top plate 110 and the head 130 can be separated from each other, and the top plate 110 and the bottom plate 120 can be separated from each other.

Meanwhile, although not illustrated in the drawing, a traction tab (not illustrated) may be located in the traction tab housing portion 134 formed in the body portion 131 of the head 130. Since this a matter obvious in the art, the detailed description thereof will not be provided As described above, the fastener of the zipper continuously advances in the fixed direction or the opposite direction through the traction tab, while gripping the traction tab with hand, thereby separating or combining the chain.

At this time, since the conventional fastener for zipper is used in a state in which the traction tab is fastened to the head, the traction tab has no structure that can be separated from the head 4.

Therefore, the traction tab is actually used only as means for moving the fastener for zipper.

However, according to the present invention, as described above, the head 130 can be separated from the top plate 110. Therefore, in the state in which the head 130 is separated from the top plate 110, the traction tab can be easily replaced.

That is, in the present invention, since the traction tab can be replaced, various types of traction tabs can be applied to the fastener for zipper in accordance with the feeling of the user and the needs of the user.

FIGS. 6 to 8 are schematic views illustrating various forms of traction tabs.

Referring to FIG. 6, a traction tab 310 according to a first example includes a first grip portion 311, and a first ring portion 312 located at a distal end region of the first grip portion 311. At this time, the first ring portion 312 may be located in the traction tab housing portion 134 formed in the body portion 131 of the head 130 of FIGS. 3 to 5.

Further, referring to FIG. 7, the traction tab 320 according to the second example includes a second grip portion 321, and a second ring portion 322 located at a distal end region of the second grip portion 321. Further, referring to FIG. 8, the traction tab 330 according to the third embodiment includes a third grip portion 331, and a third ring portion 332 located at the distal end region of the third grip portion 331.

That is, in the present invention, such various types of traction tabs 320 can be easily replaced in accordance with the feeling of the user or the needs of the user.

FIG. 9 is a separated cross-sectional view illustrating a zipper according to a second embodiment of the present invention, and FIG. 10 is a schematic plan view illustrating an example of the shape of the polygonal protruding part of a fastener for zipper according to the second embodiment of the present invention.

Hereinafter, the fastener for zipper according to the second embodiment of the present invention may refer to the aforementioned fastener for zipper according to the first embodiment of the present invention, except for the configuration to be described later. In particular, compared with the first embodiment, in the second embodiment, the portions in which the reference numerals are repeated may not be particularly referred, and in this case, the first embodiment may be referred.

First, referring to FIG. 9, a fastener for zipper 100' according to the second embodiment of the present invention includes a top plate 110, and a bottom plate 120 located corresponding to the top plate 110, and includes a head 130 which is located in a certain region of the top surface of the top plate 110 and is separable from the top plate.

At this time, the top plate 110 may include a first base plate 111, and the head 130 may be located on a certain region of the top surface of the first base plate 111.

Further, the first base plate 111 includes a first fastening hole 112.

Further, the fastener for zipper 100' according to the second embodiment of the present invention includes a head 130 which is located in a certain region of the top surface of the top plate 110 and can be separated from the top plate. The head 130 includes a body portion 131 including a traction tab housing portion 134, and a flange portion 132 extending to one distal end of the body portion 131.

Further, the head 130 includes a third fastening hole 133 which is located in a certain region of the flange portion 132 and located in a region corresponding to the first fastening hole 112.

Continuously, referring to FIG. 9, the fastener for zipper 100' according to the second embodiment of the present invention includes a polygonal protruding part 135 protruding from the bottom surface of the flange portion 132, and the protruding part 135 includes a fourth fastening hole 136 located in a region corresponding to the third fastening hole 133.

The top plate 110 of the fastener for zipper 100' according to the second embodiment of the present invention includes a protruding part housing groove 113 which is located on the top surface of the first base plate 111 and is located continuously with the first fastening hole 112.

That is, in the fastener for zipper 100' according to the second embodiment of the present invention, since the head and the top plate are fastened in the state in which the polygonal protruding part 135 of the head 130 is seated on the protruding part housing groove 113 of the top plate 110, it is possible to prevent the head from unintentionally rotating from the top plate.

More specifically, in the present invention, when the head 130 is fastened to the top plate 110 via the fastening means 140, fastening is performed in a single region, but in this case, the head may unintentionally rotate from the top plate when there is only one region to be fastened.

Therefore, in the present invention, by forming the cross-sectional shape of the protruding part 135 in a polygonal shape, and by making the polygonal protruding part seat on the protruding part housing groove, it is possible to prevent the head from unintentionally rotating from the top plate.

At this time, as illustrated in FIG. 10, the cross-sectional shape of the polygonal protruding part may be a hexagonal shape 135 or a square shape 135' or a triangular shape 135". However, in the present invention, the shape of the polygonal protruding part is not limited.

Meanwhile, reference numerals 136' and 136" which are not described mean fourth fastening holes located in a region corresponding to the third fastening hole 133.

FIG. 11 is a separated cross-sectional view illustrating a fastener for zipper according to a third embodiment of the present invention.

Hereinafter, the fastener for zipper according to the third embodiment of the present invention may refer to the aforementioned fastener for zipper according to the first and second embodiments of the present invention, except for the configuration to be described later. In particular, compared with the first and second embodiments, in the third embodiment, the portions in which the reference numerals are repeated may not be particularly referred, and in this case, the first and second embodiments may be referred.

Referring to FIG. 11, a fastener for zipper 300 according to a third embodiment of the present invention includes a top plate 110, a bottom plate 120 located corresponding to the top plate 110, and a head 130 which is located in a certain region of the top surface of the top plate 110 and is separable from the top plate.

At this time, the top plate 110 may include a first base plate 111, and the head 130 may be located on a certain region of the top surface of the first base plate 111.

Further, the first base plate 111 includes a first fastening hole 112.

In addition, the fastener for zipper 300 according to the third embodiment of the present invention includes a head 130 which is located in the certain region of the top surface of the top plate 110 and is separable from the top plate. The head 130 includes a body portion 131 including a traction tab housing portion 134, and a flange portion 132 extending to one distal end of the body portion 131.

Further, the head 130 includes a third fastening hole 133 which is located in a certain region of the flange portion 132 and located in a region corresponding to the first fastening hole 112.

Continuously, referring to FIG. 11, the fastener for zipper 300 according to the third embodiment of the present invention includes a polygonal protruding part 235 protruding from the bottom surface of the flange portion 132, and the protruding part 235 includes a fourth fastening hole 236 located in a region corresponding to the third fastening hole 133.

Further, the top plate 110 of the fastener for zipper 300 according to the third embodiment of the present invention includes a protruding part housing groove 114 which is located on the top surface of the first base plate 111, and is located continuously with the first fastening hole 112.

As described above, in the fastener for zipper 300 according to the third embodiment of the present invention, since the head and the top plate are fastened to each other in a state in which the polygonal protruding part 235 of the head 130 seats on the protruding part housing groove 114 of the top plate 110, it is possible to prevent the head from unintentionally rotating from the top plate. Since this is the aforementioned matter, the specific description thereof will not be provided below.

At this time, in the fastener for zipper 300 according to the third embodiment of the present invention, the area of the shape of the polygonal protruding part 235 becomes narrower toward the lower part, and the shape of the protruding part housing groove 114 becomes narrower toward the lower part.

That is, as illustrated in FIG. 11, the fastener for zipper 300 according to the third embodiment of the present invention has a configuration in which the area of the shape of the polygonal protruding part 235 becomes narrower toward the lower part, and the shape of the protruding part housing 114 also has a configuration in which the area becomes narrower toward the lower part in correspondence with the shape of the polygonal protruding part.

This makes it possible to easily insert the polygonal protruding part 235 into the protruding part housing groove 114, when positioning the polygonal protruding part 235 in the protruding part housing groove 114.

That is, when the size of the fastener for zipper is small, since the polygonal protruding part and the protruding part housing groove also become extremely smaller than the size of the fastener for zipper, it may be difficult to make a polygonal protruding part of a small size seat to fit the protruding part housing groove.

Therefore, in the third embodiment of the present invention, the shape of the polygonal protruding part 235 is configured so that the area becomes narrower toward the lower part, and the shape of the protruding part housing groove 114 is also configured so that the area becomes narrower toward the lower part in correspondence with the shape of the polygonal protruding part. This makes it possible to easily insert the polygonal protruding part 235 into the protruding part housing groove 114.

According to the present invention as described above, in the present invention, since the head can be separated from the top plate, the traction tab can be replaced and therefore it is possible to apply various types of traction tabs to the fastener for zipper in accordance with the user's feelings and the needs of the user.

Further, in the present invention, by providing the shape of the cross section of the protruding part in a polygonal shape and by making the polygonal protruding part seat on the protruding part housing groove, it is possible to prevent the head from unintentionally rotating from the top plate.

Further, in the present invention, the shape of the polygonal protruding part is configured so that the area becomes narrower toward the lower part, and the shape of the protruding part housing groove is also configured so that the area becomes narrower toward the lower part in correspondence with the shape of the polygonal protruding part. This makes it possible to easily insert the polygonal protruding part into the protruding part housing groove.

FIG. 12 is a separated perspective view illustrating a fastener for zipper according to a fourth embodiment of the present invention, and FIG. 13 is a combined perspective view illustrating the fastener for zipper according to the fourth embodiment of the present invention.

Hereinafter, the fastener for zipper according to the fourth embodiment of the present invention may refer to the fastener for zipper according to the first embodiment of the present invention described above, except for configurations to be described later.

Referring to FIGS. 12 and 13, a fastener for zipper 200 according to a fourth embodiment of the present invention includes a top plate 210, and a bottom plate 220 located corresponding to the top plate 210, and includes a head 230 which is located in a certain region of the top surface of the top plate 210 and is separable from the top plate.

At this time, the top plate 210 includes a first base plate 211, and the head 130 may be located in a certain region of the top surface of the first base plate 211.

Further, the first base plate 211 includes a first fastening hole 212.

Continuously, referring to FIGS. 12 and 13, the bottom plate 220 includes a second base plate 221, and a guide post 222 located in front of the second base plate 221, and the guide post 222 includes a second fastening hole 223 located in a region corresponding to the first fastening hole 212.

At this time, in the present invention, the top plate 210 and the bottom plate 220 can be separated from each other, and the top plate and the bottom plate are fastened via fastening means 240, or when the fastening means 240 is removed, the top plate 210 and the bottom plate 220 can be separated from each other.

Continuously, referring to FIGS. 12 and 13, the fastener for zipper 200 according to the fourth embodiment of the present invention includes a head 230 which is located in a certain region of the top surface of the top plate 210 and can be separated from the top plate.

At this time, as described above, the head 230 may be located in a certain region of the top surface of the first base plate 211.

Meanwhile, in the present invention, the head 230 can be separated from the top plate, and more specifically, the head 230 includes a body portion 231 including a traction tab housing portion 234, and a flange portion 232 extending to one distal end of the body portion 231.

Further, the head 230 includes a third fastening hole 233 which is located in a certain region of the flange portion 232 and located in a region corresponding to the first fastening hole 212.

The fastener for zipper 200 according to the fourth embodiment of the present invention includes fastening means 240 inserted into and fastened to the first fastening hole 212 and the third fastening hole 233. When the fastening means 240 is combined to the first fastening hole 212 and the third fastening hole 233, the top plate 210 and the head 230 are fastened to each other, and when the fastening means 240 is separated from the first fastening hole 212 and the third fastening hole 233, the top plate 210 and the head 230 can be separated from each other.

At this time, the fastening means 240 may use combining means such as a known screw or bolt, but in the present invention, the type of the fastening means 240 is not limited.

Further, as illustrated in the drawings, the fastening means 240 may be inserted into the first fastening hole 212 and the third fastening hole 233, and may be inserted into the second fastening hole 223. When the fastening means 240 is fastened to the first fastening hole 212, the third fastening hole 233 and the second fastening hole 223, the top plate 210 and the head 230 may be fastened to each other, and the top plate 210 and the bottom plate 220 may be fastened to each other.

Also, when the fastening means 240 is separated from the first fastening hole 212, the third fastening hole 233 and the second fastening hole 223, the top plate 210 and the head 230 may be separated from each other, and the top plate 210 and the bottom plate 220 may be separated from each other.

Meanwhile, although not illustrated in the drawings, a traction tab (not illustrated) may be located in the traction tab housing portion 234 formed in the body portion 231 of the head 230, and since this is an obvious matter in the art, the specific description thereof will not be provided below.

As described above, the fastener of the zipper will continuously advances in the fixed direction or the opposite direction through the traction tab, while gripping the traction tab by hand, thereby separating or combining the chain.

As described above, since the traction tab is fastened to the head in the conventional fastener for zipper, the traction tab has no structure that is separable from the head 4.

Therefore, the traction tab is actually used only as a means for moving the fastener for zipper.

However, according to the present invention, as described above, the head 230 is separable from the top plate 210. Therefore, the traction tab can be easily replaced in the state of separating the head 230 from the top plate 210.

That is, in the present invention, since the traction tab can be replaced, various types of traction tabs can be applied to the fastener for zipper in accordance with the feeling of the user and the needs of the user.

Hereinafter, the fastener for zipper according to the fourth embodiment of the present invention will be more specifically described.

FIG. 14 is a perspective view illustrating the bottom plate of the fastener for zipper according to the fourth embodiment of the present invention, FIG. 15 is a side view illustrating the bottom plate of the fastener for zipper according to the fourth embodiment of the present invention, and FIG. 16 is a plan view illustrating the bottom plate of the fastener for zipper according to the fourth embodiment of the present invention.

Referring to FIGS. 14 to 16, as described above, the bottom plate 220 of the fastener for zipper according to the fourth embodiment of the present invention includes a second base plate 221, a guide post 222 located in front of the second base plate 221, and the guide post 222 includes a second fastening hole 223 located in a region corresponding to the first fastening hole 212.

At this time, the guide post 222 includes a guide post top surface 224. The guide post top surface 224 includes a first top surface **224*a* in which the second fastening hole 223 is located, and a second top surface 224*b* located at the outer distal end of the support post 222 and having a level difference lower than the first top surface 224*a***.

Further, the guide post 222 includes a protruding part 225 located in a certain region of the guide post top surface 224.

A combining relation between the top surface 224 of the guide post including the first top surface **224*a* and the second top surface 224*b* and the top plate of the fastener for zipper as described above, and a combining relation between the protruding part 225** and the top plate of the fastener for zipper as described above will be described later.

FIG. 17 is a perspective view in a first direction illustrating the top plate of the fastener for zipper according to the fourth embodiment of the present invention, and FIG. 18 is a perspective view in a second direction illustrating the top plate of the fastener for zipper according to the fourth embodiment of the present invention.

At this time, the first direction may mean the bottom surface of the top plate, and the second direction may mean the top surface of the top plate.

Referring to FIGS. 17 and 18, as described above, the top plate 210 of the fastener for zipper according to the fourth embodiment of the present invention includes a first base plate 211, and a first fastening hole 212 located in a certain region of the first base plate 211.

Referring to FIG. 17, the top plate 210 includes the bottom surface 213 of the first base plate 211, and the bottom surface 213 of the first base plate 211 includes a first bottom surface 213*a* of the first base plate located at one distal end of the first base plate, and a second bottom surface 213*b* of the first base plate which is a region other than the first bottom surface of the first base plate.

Further, the bottom surface 213 of the first base plate 211 may include a housing groove 214 which is located in a certain region of the bottom surface 213 of the first base plate 211 and has a level difference lower than the bottom surface 213 of the first base plate 211, and the first fastening hole 212 may be included in a certain region of the housing groove 214.

Further, the bottom surface 213 of the first base plate 211 includes a first groove portion 217 which is located over the first bottom surface 213*a* of the first base plate and the housing groove 214 and has a level difference lower than the housing groove 214.

At this time, the first bottom surface 213*a* of the first base plate corresponds to the surface coming into contact with the second top surface 224*b*, among the guide post top surface 224 of the bottom plate 220 of FIGS. 14 to 16.

That is, in a state in which the first bottom surface 213*a* of the first base plate is in contact with the second top surface 224*b* of the guide post top surface 224, the top plate 210 and the bottom plate 220 can be fastened to each other.

Further, the housing groove 214 corresponds to a groove that houses the first top surface 224*a*, of the guide post top surface 224 of the bottom plate 220 of FIGS. 14 to 16.

That is, in the present invention, in a state in which the first top surface 224*a* of the guide post top surface 224 of the bottom plate 220 is housed in the housing groove 214, the top plate 210 and the bottom plate 220 are fastened to each other, thereby making it possible to make the combining between the top plate 210 and the bottom plate 220 stronger.

Further, the first groove portion 217 corresponds to a groove that houses the protruding part 225 of the bottom plate 220 of FIGS. 14 to 16.

That is, in a state in which the protruding part 225 of the bottom plate 220 is housed in the first groove portion 217, the top plate 210 and the bottom plate 220 can be fastened to each other.

At this time, when the top plate 210 and the bottom plate 220 are fastened to each other, since the protruding part 225 is housed in the first groove portion 217, the fastening reference point between the top plate and the bottom plate 220 can be presented.

Referring to FIG. 18, the top plate 210 includes the top surface 215 of the first base plate 211, and the top surface 215 of the first base plate 211 includes the first top surface 215*a* of the first base plate located at the other distal end of the first base plate, and the second top surface 215*b* of the first base plate which is a region other than the first top surface of the first base plate.

Further, the top surface 215 of the first base plate 211 may include a support groove 216 which is located in a certain region of the first top surface 215*a* of the first base plate, of the top surface 215 of the first base plate 211.

The top surface 215 of the first base plate 211 may include a second groove portion 218 located between the support groove 216 and the first fastening hole 212.

A combining relation between the support groove 216 located in a certain region of the first top surface 215*a* of the first base plate and the head of the fastener for zipper as described above, and a combining relation between the second groove portion 218 located between the support groove 216 and the first fastening hole 212 and the head of the fastener for zipper will be described later.

FIG. 19 is a perspective view illustrating the head of the fastener for zipper according to the fourth embodiment of the present invention, and FIG. 20 is a side view illustrating the head of the fastener for zipper according to the fourth embodiment of the present invention.

Referring to FIGS. 19 and 20, as described above, the head 230 of the fastener for zipper according to the fourth embodiment of the present invention includes a body portion 231 including a traction tab housing portion 234, and a flange portion 232 extending to one distal end of the body portion 231. Further, the head 230 includes a third fastening hole 233 which is located in a certain region of the flange portion 232 and located in a region corresponding to the first fastening hole 212.

At this time, referring to FIG. 20, the flange portion 232 of the head 230 of the fastener for zipper according to the fourth embodiment of the present invention includes a flange portion bottom surface 232*a*, and in a state in which the flange portion bottom surface 232*a* is brought into contact with the top surface 215 of the first base plate 211 of the top plate 210, the top plate 210 and the head 230 can be fastened to each other.

Referring to FIG. 20, the body portion 231 of the head 230 has a semi-annular shape, and the traction tab housing portion 234 can be formed by the semi-annular shape.

At this time, the flange portion 232 extends from one region of the semi-annular shape, and the flange portion may extend from one region of the semi-annular shape in a first direction, for example, in a horizontal direction.

Further, the head 230 may include a protruding part 251 extending from one region of the semi-annular shape of the body portion 231 in a second direction, for example, a vertical direction.

Meanwhile, the other region of the semi-annular shape includes a linear support 241, and the support 241 has a first support 241*a* of a first length t1, and a second support 241*b* of a second length t2 extending from the first support 241*a*.

At this time, as illustrated in the drawing, the support 241 protrudes from the flange portion bottom surface 232*a* by the second length t2 of the second support 241*b*.

Continuously, referring to FIGS. 19 and 20, as described above, in a state in which the flange portion bottom surface 232*a* is brought into contact with the top surface 215 of the first base plate 211 of the top plate 210 of FIGS. 17 and 18, the top plate 210 and the head 230 can be fastened to each other.

At this time, when the top plate 210 and the head 230 are fastened to each other, the support 241 is inserted into a support groove 216 located in a fixed region of the first top surface 215*a* of the first base plate of the top plate 210, and more specifically, the second support 241*b* of the support 241 is inserted into the support groove 216.

That is, since the head and the top plate are fastened to each other in the state in which the second support 241*b* of the support 241 is inserted into the support groove 216, the fastener for zipper 200 according to the fourth embodiment of the present invention can prevent the head from unintentionally rotating from the top plate.

More specifically, in the present invention, when the head 230 is fastened to the top plate 210 via the fastening means 240, fastening is performed in a single region. However, when there is only one region to be fastened, the head may unintentionally rotate from the top plate.

Therefore, in the present invention, since the head and the top plate are fastened to each other in the state in which the second support 241*b* of the support 241 is inserted into the support groove 216, it is possible to prevent the head from unintentionally rotating from the top plate.

Further, the head 230 includes a protruding part 251 extending from one region of the semi-annular shape of the body portion 231 in the second direction, for example, the vertical direction, and in the state in which the protruding part 251 is inserted into the second groove portion 218 located between the support groove 216 of the top plate of FIGS. 17 and 18 and the first fastening hole 212, the plate 210 and the head 230 can be fastened to each other.

The insertion of the protruding part 251 into the second groove portion 218 can prevent the unintentional rotation of the head from the top plate and can present the fastening reference point between the top plate 210 and the head 230 when fastening the head to the top plate, like the aforementioned second support 241*b*.

According to the present invention as described above, since the head can be separated from the top plate in the present invention, it is possible to replace the traction tab and therefore it is possible to apply various types of traction tabs to the fasteners for zipper in accordance with feeling of the user and the needs of the user.

In the present invention, since the top plate 210 and the bottom plate 220 are fastened to each other in a state in which the first top surface 224*a* of the guide post top surface 224 of the bottom plate 220 is housed in the housing groove 214, it is possible to make the combining between the top plate 210 and the bottom plate 220 stronger.

Further, in the present invention, since the head and the top plate are fastened to each other in the state in which the second support 241*b* of the support 241 is inserted into the support groove 216, it is possible to prevent unintentional rotation of the head from the top plate.

While the present invention has been particularly illustrated and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

It is claimed:

1. A fastener for zipper comprising:

a top plate;

a bottom plate located to correspond to the top plate; and a head which is located in a certain region of a top surface of the top plate and is separable from the top plate, wherein the top plate comprises a first base plate, and a first fastening hole located on the first base plate, the bottom plate comprises a second base plate, a guide post located in front of the second base plate, and a second fastening hole located in the guide post and located in a region corresponding to the first fastening hole, and the head comprises a body portion including a traction tab housing portion, a flange portion extending to one distal end of the body portion, and a third fastening hole located in a certain region of the flange portion and located in the region corresponding to the first fastening hole.

2. The fastener according to claim 1, further comprising:

fastening means inserted into and fastened to the third fastening hole wherein, when the fastening means is combined to the first fastening hole and the third fastening hole, the top plate and the head are fastened to each other, and when the fastening means is separated from the first fastening hole and the third fastening hole, the top plate and the head are separated from each other.

3. The fastener according to claim 1, further comprising:

fastening means inserted into and fastened to the first fastening hole, the third fastening hole and the second fastening hole, wherein, when the fastening means is combined to the first fastening hole, the third fastening hole and the second fastening hole, the top plate and the head are fastened to each other, and the top plate and the bottom plate are fastened to each other, and when the fastening means are separated from the first fastening hole, the third fastening hole and the second fastening hole, the top plate and the head are separated from each other, and the top plate and the bottom plate are separated from each other.

4. The fastener according to claim 1, wherein the head further includes a polygonal protruding part protruding from a bottom surface of the flange portion, the protruding part including a fourth fastening hole located in a region corresponding to the third fastening hole, and the top plate further includes a protruding part housing groove which is located on the top surface of the first base plate and located continuously with the first fastening hole.

5. The fastener according to claim 4, wherein an area of a shape of the polygonal protruding part becomes narrower toward a lower part, and an area of a shape of the protruding part housing groove becomes narrower toward to a lower part.

6. A fastener for zipper comprising:

a top plate;

a bottom plate located to correspond to the top plate; and a head which is located in a certain region of a top surface of the top plate and is separable from the top plate, wherein the top plate comprises a first base plate, and a first fastening hole located on the first base plate, the bottom plate comprises a second base plate, a guide post located in front of the second base plate, and a second fastening hole located in the guide post and located in a region corresponding to the first fastening hole, and the head comprises a body portion including a traction tab housing portion, a flange portion extending to one distal end of the body portion, and a third fastening hole located in a certain region of the flange portion and located in a region corresponding to the first fastening hole, and the guide post comprises a guide post top surface, and the guide post top surface comprises a first top surface on which the second fastening hole is located, and a second top surface located at an outer distal end of the guide post and having a level difference lower than the first top surface.

7. The fastener according to claim 6, wherein the top plate comprises a bottom surface of the first base plate, the bottom surface of the first base plate comprises a first bottom surface of the first base plate located at one distal end of the first base plate, a second bottom surface of the first base plate as a region other than the first bottom surface of the first base plate, and a housing groove located in a certain region of the bottom surface of the first base plate and having a level difference lower than the first bottom surface of the first base plate, the top plate and the bottom plate are fastened to each other in a state in which the first bottom surface of the first base plate is in contact with the second top surface of the guide post top surface, and the top plate and the bottom plate are fastened to each other in a state in which the first top surface of the guide post top surface of the bottom plate is housed in the housing groove.

8. The fastener according to claim 7, wherein the guide post further comprises a protruding part located in a certain region of the guide post top surface, the bottom surface of the first base plate further comprises a first groove portion disposed over the first bottom surface of the first base plate and the housing groove and having a level difference lower than the housing groove, and the top plate and the bottom plate are fastened to each other in a state in which the protruding part is housed in the first groove portion.

9. The fastener according to claim 7, wherein the top plate comprises a top surface of the first base plate, the top surface of the first base plate comprises a first top surface of the first base plate located at the other distal end of the first base plate, a second top surface of the first base plate which is a region other than the first top surface of the first base plate, a support groove located in a certain region of the first top surface of the first base plate, and a second groove portion located between the support groove and the first fastening hole, the flange portion of the head comprises a flange portion bottom surface, and the top plate and the head are fastened to each other in a state in which the flange portion bottom surface comes into contact with the top surface of the first base plate.

10. The fastener according to claim 9, wherein the body portion of the head has a semi-annular shape, the flange portion extending in a first direction from one region of the semi-annular shape, the other region of the semi-annular shape comprises a linear support, the linear support comprising a first support having a first length t1, and a second support extending from the first support and having a second length t2, and the linear support protrudes from the flange portion bottom surface by the second length t2 of the second support.

11. The fastener according to claim 10, wherein the head further comprises a protruding part extending in a second direction from the one region of the semi-annular shape of the body portion.

12. The fastener according to claim 10, wherein the top plate and the head are fastened to each other in the state in which the flange portion bottom surface comes into contact with the top surface of the first base plate of the top plate, the head and the top plate are fastened to each other in the state in which the second support of the linear support is inserted into the support groove, and the top plate and the head are fastened to each other in the state in which a protruding part is inserted into the second groove portion.

* * * * *